US005125372A

United States Patent [19]

Gondek

[11] Patent Number: 5,125,372

[45] Date of Patent: Jun. 30, 1992

[54] HYDRAULICALLY OPERATED ENGINE VALVE SYSTEM

[76] Inventor: John T. Gondek, 1641 Innsbruck Cir. West, Minneapolis, Minn. 55421

[21] Appl. No.: 795,312

[22] Filed: Nov. 20, 1991

Related U.S. Application Data

[62] Division of Ser. No. 498,329, Mar. 23, 1990, Pat. No. 5,090,366.

[51] Int. Cl.[5] ..... F01L 9/02; F01L 1/34

[52] U.S. Cl. ..... 123/90.17; 123/90.15; 123/90.12

[58] Field of Search ..... 123/90.12, 90.13, 90.16, 123/90.17, 90.15

[56] References Cited

U.S. PATENT DOCUMENTS

| | | | |
|---|---|---|---|
| 1,301,972 | 4/1919 | Ricardo | 123/90.17 |
| 1,692,845 | 11/1928 | Kolb | 123/90.13 |
| 1,757,046 | 5/1930 | Horine | 123/90.17 |
| 1,763,154 | 6/1930 | Holzwarth | 123/90.12 |
| 2,057,354 | 10/1936 | Withers et al. | 123/90.17 |
| 2,306,131 | 12/1942 | Lossau | 123/90.12 |
| 2,788,777 | 4/1957 | Clark | 123/90.12 |
| 2,888,837 | 6/1959 | Hellman | 123/90.12 |
| 2,915,052 | 12/1959 | Gullen | 123/90.12 |
| 3,139,077 | 6/1964 | Beucher | 123/90.12 |
| 3,516,394 | 6/1970 | Nichols | 123/90.17 |
| 3,633,555 | 1/1972 | Raggi | 123/90.17 |
| 4,258,672 | 3/1981 | Hietikko | 123/90.12 |
| 4,388,897 | 6/1983 | Rosa | 123/90.17 |
| 4,476,823 | 10/1984 | Williams | 123/90.12 |
| 4,510,900 | 4/1985 | Quenneville | 123/90.12 |
| 4,522,085 | 6/1985 | Kane | 123/90.17 |
| 4,612,883 | 9/1986 | Brisko | 123/90.12 |
| 4,716,862 | 1/1989 | Sauro | 123/90.12 |
| 4,770,060 | 9/1988 | Elrod et al. | 74/640 |
| 4,771,742 | 9/1988 | Nelson et al. | 123/90.17 |
| 4,799,462 | 1/1989 | Tittizer et al. | 123/90.12 |
| 4,821,689 | 4/1989 | Tittizer et al. | 123/90.12 |
| 4,858,572 | 8/1989 | Shirai et al. | 123/90.12 |
| 4,896,633 | 1/1990 | Junghans et al. | 123/90.12 |
| 4,898,128 | 2/1990 | Meneely | 123/90.12 |
| 4,898,129 | 2/1990 | Junghans et al. | 123/90.13 |
| 4,901,684 | 2/1990 | Wride | 123/90.12 |

FOREIGN PATENT DOCUMENTS

| | | | |
|---|---|---|---|
| 0282166 | 4/1988 | European Pat. Off. | 123/90.17 |
| 357844 | 3/1938 | Italy | 123/90.12 |

OTHER PUBLICATIONS

*Camlobe Phasing Changes IC Engine Valve Timing,* p. 142 Design News Oct. 5, 1987.

*Quad 4: The Inside Story,* p. 63 Popular Mechanics Feb. 1988.

*Detroit '88: Stronger Engines, Smoother Platforms,* p. 56 Machine Design Jan. 7, 1988.

*Third Valve Augments Engine Breaking Capacity,* p. 90 Design News Jun. 22, 1987.

*Primary Examiner*—E. Rollins Cross
*Assistant Examiner*—Thomas N. Moulis
*Attorney, Agent, or Firm*—Kinney & Lange

[57] ABSTRACT

An internal combustion engine comprises an engine head having at least one cylinder and a crank shaft. Each cylinder holds a piston for driving the crank shaft. At least one intake and one exhaust valve assembly is positioned adjacent each cylinder. Each intake and each exhaust valve assembly includes a valve with an opened position and a closed position. The valve opens a cylinder port in the opened position and seals the cylinder port in the closed position. A valve controller applies hydraulic signals to each valve assembly which actuate each valve between the opened and closed positions as a function of the piston position.

7 Claims, 8 Drawing Sheets

24a
16a
61
59
12
44

58
56
48
76
74
60
64
62
26a
70
72
53
55
57
54
50
52
18a
46

210
300
292
294
298
36
222
220
244
296
34
296
290
254
226
256
234
224
230
266
218
252
250
265
262
264
216
264
260
258
240
100
270
34
272
274
282
242
214
280
212
280
286
286

HYDRAULICALLY OPERATED ENGINE VALVE SYSTEM

This is a divisional of application Ser. No. 07/498,329, filed Mar. 23, 1990, now U.S. Pat. No. 5,090,366.

BACKGROUND OF THE INVENTION

The present invention relates to an internal combustion engine having hydraulically operated valves with intake and exhaust timing parameters that are independently adjustable during engine operation.

For years, engine designers have been trying to optimize engine performance, fuel economy, and emissions control. These design goals are now largely dependent upon intake and exhaust valve timing parameters such as opening points, closing points and overlap. Valve opening and closing points are measured relative to a piston position or to a crank shaft rotation angle within a combustion cycle.

Conventional engines control valve operation and timing with a cam shaft. The cam shaft includes a cam lobe for each valve. As the cam shaft rotates, cam followers follow the circumference of each cam lobe. Each cam follower is mechanically coupled to a respective valve. Movement of the cam followers actuate the valves between opened and closed positions.

Each cylinder has an intake valve and an exhaust valve which are controlled by an intake cam lobe and an exhaust cam lobe on the cam shaft. In some designs, each cylinder includes additional intake and exhaust valves controlled by additional cams. Opening and closing points are determined by the shape of the cam lobes. Valve overlap is determined by angular positioning of the intake cam lobes with respect to the exhaust cam lobes.

In the past, the position and shape of these cam lobes were fixed. Engine designers would design the cam shaft for a selected operating torque and speed range. As a result, engine performance had to be compromised for all ranges outside the selected range.

Attempts have been made to overcome some of these design problems. In one version, the entire cam shaft is rotated relative to the engine's crankshaft to either advance or retard valve timing within the combustion cycle.

In another version, the angular positions of the intake cam lobes can be adjusted about the cam shaft relative to the exhaust cam lobes. Alternatively, the exhaust cam lobes can be adjusted relative to the intake cam lobes. The cam shaft in such a design includes an inner shaft and an outer tubular shaft. The fixed cam lobes are secured to the outer tubular shaft and the rotatable cam lobes are secured to the inner shaft. During operation, the inner shaft is rotated relative to the outer tubular shaft to vary overlap between the intake and exhaust valves.

In yet another version, the opening or closing points can be adjusted by using two-piece cam lobes. Each intake cam is divided into an opening cam lobe and a closing cam lobe. The adjustment changes the angular positioning of one of the lobes on each intake cam. Depending upon the configuration, either the opening cam lobe or the closing cam lobe may be adjusted. Alternatively, the adjustments may be made to the exhaust cam lobes. These designs have only a single phasing unit that shifts the angular position of either the inner or outer shaft. A single phasing unit does not allow adjustment of both the intake and the exhaust cam lobes relative to the crank shaft angle.

Two-phasing units allow two means of adjustment. With two phasing units, the relative angular positions of both the intake cam and the exhaust cam can be adjusted with respect to the crank shaft angle.

In yet another version, the intake and the exhaust cam lobes are two-piece cams with an opening cam lobe and a closing cam lobe. The opening cam lobe determines when the respective valve opens while the closing cam lobe determines when the valve closes. Two phasing units allow independent adjustment of the opening and closing cam lobes for either the intake cams or the exhaust cams, but not both. The two-phasing units may be controlled by digital circuitry to provide real-time adjustment of valve timing parameters based upon a number of operating variables.

Two-phasing units provide a limited choice of adjustment. Due to cost, design, and spatial constraints, it would be impractical to add any further adjustments to this type of cam shaft.

In addition, designers choose valve orientation within the engine head to optimize fuel/air flow. Valve orientation, however, is compromised because of spatial constraints and the position of the cam shaft. With mechanically operated valves, the cam shaft must be positioned close to the valves. Otherwise, the required mechanical linkage between the cam shaft and the valves is impractical. Optimum sparkplug positioning may also be compromised. These spatial constraints ultimately limit engine efficiency and power.

One method of developing more power is to move fuel/air mixture into and exhaust out of each cylinder more efficiently by having two intake and two exhaust valves per cylinder. This creates even more space problems in the engine head. More valves also require more cam lobes which makes the cam shaft design more complex. Cam lobe adjustments are therefore even more costly and impractical.

The prior art lacks a valve control system that is fully adjustable with respect to valve overlap, valve opening points, and valve closing points. The prior art further lacks a valve control system that alleviates the spatial constraints normally created by complex valve control systems.

SUMMARY OF THE INVENTION

The present invention provides an internal combustion engine with a hydraulically operated valve control system that optimizes engine efficiency at all speed and torque combinations. The valve control system is fully adjustable with respect to valve overlap, valve opening points, and valve closing points. Further, the valve control system allows for independent timing adjustments of the intake and the exhaust valves. Even further, the valve control system alleviates the spatial constraints normally associated with valve control systems by reducing the complexity and cost. In systems of the prior art, increasing the timing adjustment flexibility results in increasing the spatial constraints. The present invention, however, increases the timing adjustment flexibility while reducing the spatial constraints.

In accordance with the present invention, the internal combustion engine comprises an engine block and head which have at least one cylinder and a crank shaft. Each cylinder holds a piston for driving the crankshaft. At least one valve assembly is positioned adjacent each cylinder and includes a valve with an opened position and a closed position. The valve opens a cylinder port in the opened position and seals the cylinder port in the closed position. A valve controller applies hydraulic signals to each valve assembly which actuate each valve between the opened and closed positions as a function of piston position. The valve assemblies of the present invention may be freely positioned in the cylinder head without the constraint of the cam shaft positioning. The valve controller includes a timing adjustment assembly which adjusts actuation of each valve with respect to piston position as a function of engine operating parameters. In a preferred embodiment, the valve controller includes a cam shaft with an intake cam and an exhaust cam. The intake cam and the exhaust cam are two-piece cams, each having an opening cam and a closing cam. Each of the opening and closing cams have angular positions on the cam shaft that are independently adjustable to advance or retard valve actuation.

The valve controller further includes a plurality of intake cam followers that are positioned radially about the intake cam and a plurality of exhaust cam followers that are positioned radially about the exhaust cam. The intake and exhaust cam followers follow the circumference of the intake and exhaust cams as they rotate within the valve controller. Each cam follower produces hydraulic signals to control actuation of each valve.

The valve controller requires only one intake and one exhaust cam to support any number of valves. In contrast, valve controllers of the prior art require one cam per valve. The present invention is therefore less complex and cheaper to build. Since the valve controller of the present invention is a separate unit that is coupled to the valves through hydraulic lines, it may be positioned anywhere in an engine compartment to thereby reduce the spatial constraints near the valves.

DETAILED DESCRIPTION OF THE PREFERRED EMBODIMENTS

1. System Operation

Figure 1A:
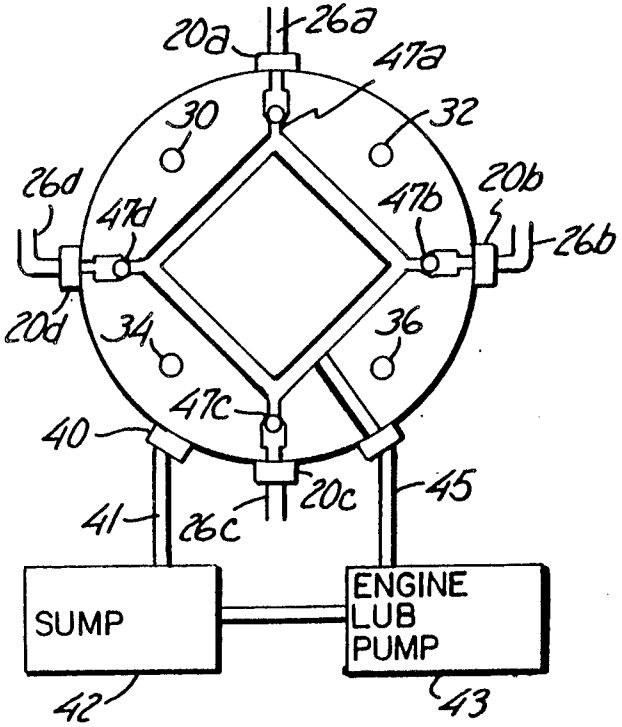
FIG. 1*a* is a system diagram of a hydraulic fluid replenishing system for a hydraulic valve controller in accordance with the present invention.
Figure 1:
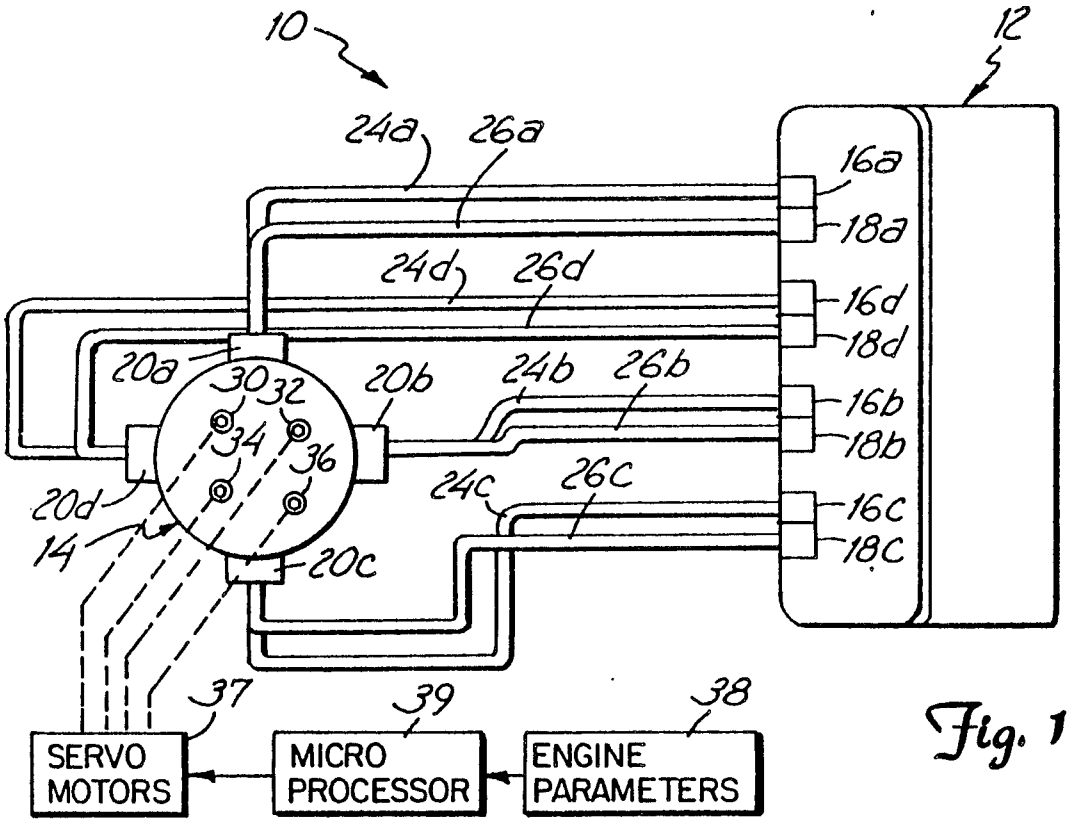
FIG. 1 is a system diagram of an engine having hydraulically controlled valve assemblies in accordance with the present invention.

FIG. 1 is a system diagram of an engine having hydraulically controlled valve assemblies in accordance with the present invention. An engine 10 includes an engine head 12 and a valve controller 14. The engine head 12 includes four cylinders (not shown). Adjacent the cylinders are intake valve assemblies 16*a*, 16*b*, 16*c*, and 16*d*, and exhaust valve assemblies 18*a*, 18*b*, 18*c* and 18*d*.

The valve controller 14 includes exhaust cam follower assemblies 20*a*, 20*b*, 20*c* and 20*d*. Positioned directly behind the exhaust cam follower assemblies are intake cam follower assemblies 22*a*, 22*b*, 22*c*, and 22*d* (shown in FIG. 3). The intake and exhaust cam follower assemblies 22*a*-22*d* and 20*a*-20*d* are spaced radially about the circumference of the valve controller 14. The intake hydraulic lines 24*a*, 24*b*, 24*c*, and 24*d* are coupled between the intake cam follower assemblies 22*a*-22*d* and the intake valve assemblies 16*a*-16*d*, respectively. The exhaust hydraulic lines 26*a*, 26*b*, 26*c* and 26*d* are coupled between the exhaust cam follower assemblies 20*a*-20*d* and the exhaust valve assemblies 18*a*-18*d*, respectively.

The intake and exhaust cam follower assemblies 22*a*-22*d* and 20*a*-20*d* send hydraulic signals through the intake hydraulic lines 24*a*-24*d* and the exhaust hydraulic lines 26*a*-26*d* to control operation of the intake and exhaust valve assemblies 16*a*-16*d* and 18*a*-18*d*. In a preferred embodiment, all of the intake hydraulic lines 24*a*-24*d* are the same length and all of the exhaust hydraulic lines 26*a*-26*d* are the same length. Since the hydraulic signals have inherent time delays while traveling through the hydraulic lines, this length requirement ensures similar timing of each intake valve assembly 16*a*-16*d* and similar timing of each exhaust valve assembly 12*a*-12*d*. In the preferred embodiment, it is not required that the intake hydraulic lines 24*a*-24*d* have the same length as the exhaust hydraulic lines 26*a*-26*d*.

The valve controller 14 further includes timing pinions 30, 32, 34 and 36. The timing of the valve assemblies 16*a*-16*d* and 18*a*-18*d* may be varied during engine operation by rotating the timing pinions 30, 32, 34 and 36. Preferably, one or more electric servo motors 37 control rotation of the timing pinions 30, 32, 34, 36 based upon several engine operating parameters 38. A microprocessor 39 receives the engine operating parameters 38 and supplies control signals to the electric servo motors 37 for adjusting the timing parameters to obtain optimum performance of the engine 10. The control signals are based upon one or more of the operating parameters 38.

FIG. 1 illustrates the present invention as applied to a four cylinder engine. Alternatively, the present invention may be applied to engines having any number of cylinders. For example, a one cylinder engine would have one intake valve assembly, one exhaust valve assembly, one intake cam follower, and one exhaust cam follower. A six cylinder engine would have six intake and six exhaust valve assemblies and six intake and six exhaust cam follower assemblies. The six intake and exhaust cam follower assemblies would be spaced radially about the circumference of the valve controller.

2. Hydraulic Fluid Replacement

FIG. 1*a* is a system diagram of a hydraulic fluid replenishing system for the valve controller 14. The valve controller 14 includes the exhaust cam follower assemblies 20*a*, 20*b*, 20*c* and 20*d* which control actuation of hydraulic fluid within the hydraulic lines 26*a*, 26*b*, 26*c* and 26*d*, respectively. The valve controller 14 further includes the timing pinions 30, 32, 34 and 36. During operation of the valve controller 14, small amounts of hydraulic fluid is lost within the controller. A fluid drain 40 prevents the lost fluid from collecting within the valve controller 14 by allowing the fluid to drain through a drain line 41. The drain line 41 may be connected to a sump 42 which draws the lost fluid through the drain line. An engine lubricating pump 43 replaces the lost fluid through replenishing lines 45. The sump 42 may be connected the pump 43 to recycle the lost fluid into the controller 14. The replenishing lines 45 feed hydraulic fluid to the exhaust cam follower assemblies 20*a*, 20*b*, 20*c* and 20*d* through check valves 47*a*, 47*b*, 47*c* and 47*d*, respectively. Alternatively, the check valves 47*a*–47*d* may be replaced with fluid replacement ports (not shown), as discussed in greater detail with reference to FIG. 5. The replenishing lines 45 also feed hydraulic fluid to the intake cam follower assemblies 22*a*, 22*b*, 22*c* and 22*d* (shown in FIG. 3). In this manner, the replenishing system continually recycles the hydraulic fluid and thereby reduces the overall operating temperature of the fluid.

3. Hydraulic Valve Assembly

Figure 2:
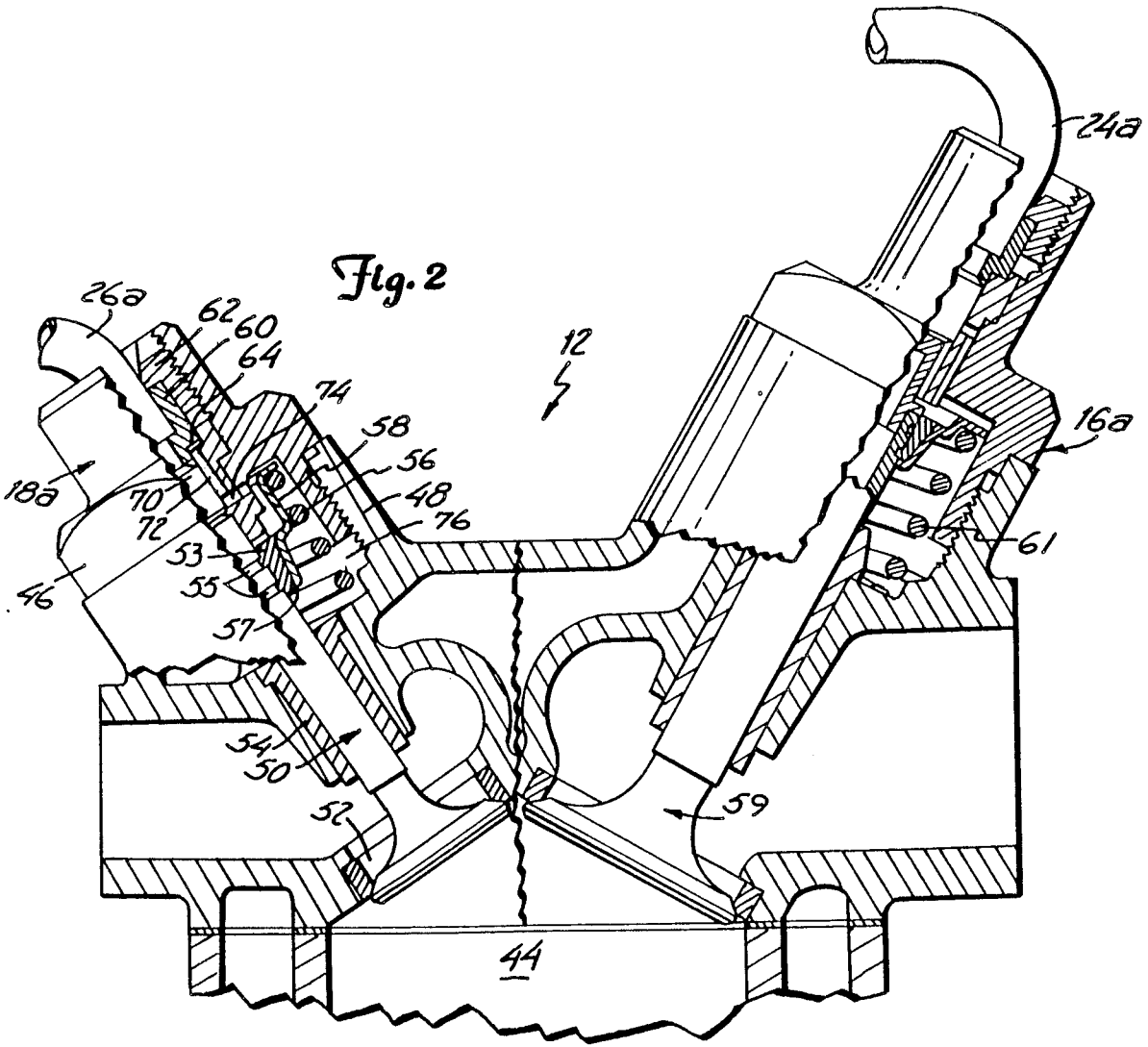
FIG. 2 is a sectional view with portions broken away of an engine head with hydraulically operated valves in accordance with the present invention.

FIG. 2 is a sectional view of the engine head 12 with portions broken way. The engine head 12 includes the intake valve assembly 16*a* and the exhaust valve assembly 18*a* which are positioned adjacent to a cylinder 44. The intake valve assembly 16*a* includes essentially the same components and performs essentially the same function as the exhaust valve assembly 18*a*. The discussion is limited to the exhaust valve assembly 18*a*. It should be understood that the discussion also applies to the intake valve assembly 16*a*.

The exhaust valve assembly 18*a* is secured to the engine head 12 by an exhaust valve cap 46. The exhaust valve cap 46 is screwed into bore 48 of the engine head 12. The exhaust valve assembly 18*a* includes an exhaust valve 50 which is actuated between opened and closed positions with respect to an exhaust valve port 52. In the closed position, the exhaust valve 50 seals the exhaust valve port 52. In the opened position, the exhaust valve 50 extends into the cylinder 44 to allow exhaust to escape through the exhaust port 52. The exhaust valve 50 extends into the engine head through an exhaust valve sleeve 54. An exhaust valve spring 56 is positioned between the engine head 12 and an exhaust valve spring cap 58 to bias the exhaust valve 50 in the normally closed position. A two-piece locking ring 53 is positioned around the exhaust valve 50 and within the exhaust valve spring cap 58. The locking ring 53 mates with grooves 55 of the valve 50 and engages a lip 57 of the valve spring cap 58.

The exhaust hydraulic line 26*a* is secured to the exhaust valve assembly 18*a* by a tube end fitting 60 and a tube locking screw 62. The hydraulic line 26*a* may be silver soldered to the tube end fitting 60. The tube locking screw 62 secures the tube end fitting 60 to the exhaust valve cap 46. A fitting gasket 64 provides a fluid-tight seal about the tube end fitting 60. The exhaust hydraulic line 26*a* holds hydraulic fluid which transmits hydraulic signals from the exhaust cam follower assembly 20*a* (shown in FIG. 1) to the exhaust valve assembly 18*a*. The hydraulic signals are pressure signals and include a pressure head that travels through the hydraulic fluid.

The pressure head forces an exhaust valve piston 70 downward along an exhaust valve piston sleeve 72. The exhaust valve piston 70 drives the exhaust valve 50 into the opened position when the pressure head supplies an opening force that is greater than the closing force of the exhaust valve spring 56.

If the pressure head forces the exhaust valve piston 70 past an exhaust valve travel limit port 74, the hydraulic fluid escapes into a cavity 76 which releases the hydraulic pressure so that the exhaust valve 50 does not travel too far into the cylinder 44.

The exhaust valve piston 70 decreases hydraulic fluid loss. The piston 70 and the piston sleeve 72 are finished to a very small clearance. The close-fitting piston sleeve 72 increases the efficiency of the hydraulic signals by reducing the hydraulic fluid loss past the piston 70.

In a preferred embodiment, engine lubrication oil is used as the hydraulic fluid. The oil that passes by the exhaust piston 70 collects in the cavity 76 and is returned to an engine oil pan (not shown). The exhaust valve travel limit port 74 may be replaced in a known manner by a relief valve (not shown). The replenishing lines 45 (shown in FIG. 1*a*) replace the lost oil when the oil pressure within the hydraulic line 26*a* drops below a specified magnitude. Oil replacement will be discussed in more detail later with reference to FIG. 5.

The intake valve assembly 16*a* includes an intake valve 59. The intake valve 59 is actuated between opened and closed positions as a function of the hydraulic signals transmitted through the intake hydraulic line 24*a*. An intake valve spring 61 biases the intake valve in the normally closed position. Construction and operation of the intake valve assembly 16*a* is generally similar to the exhaust valve assembly 18*a*.

4. Hydraulic Valve Controller

Figure 3:
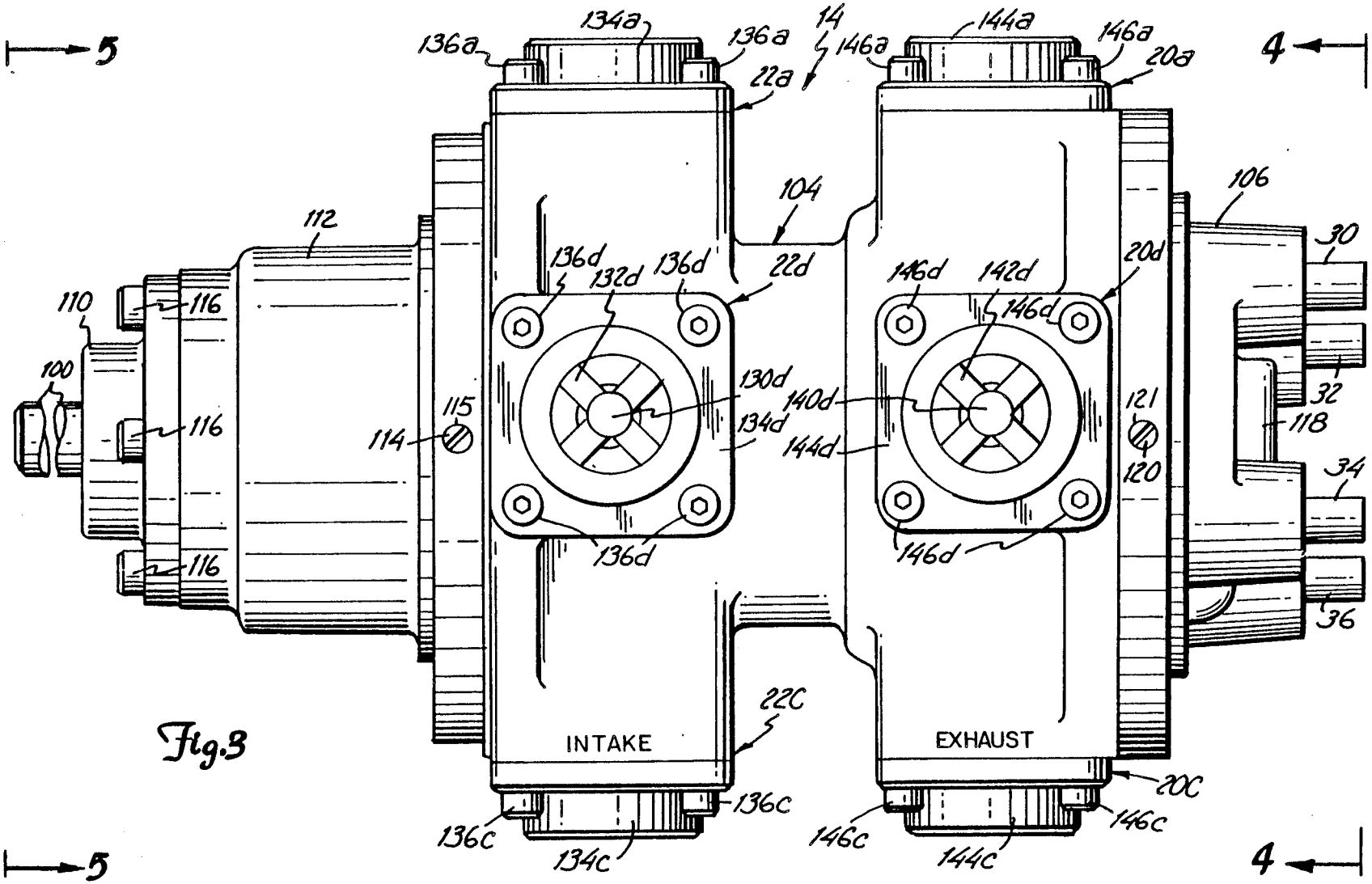
FIG. 3 is a view in side elevation of a hydraulic valve controller in accordance with the present invention.

FIG. 3 is a view in side elevation of the valve controller 14 shown in FIG. 1. The valve controller 14 includes a cam shaft 100, a bearing cap 110, a bearing housing 112, a housing 104, and a shaft end cap 106. The bearing housing 112, the housing 104 and the shaft end cap 106 substantially enclose the cam shaft 100. The bearing housing 112 supports a proximal end of the cam shaft 100 within the housing 104. A plurality of screws 116 secure the bearing cap 110 to the bearing housing 112.

The shaft end cap 106 supports a distal end of the cam shaft 100 within the housing 104 in a hub 118. The shaft end cap 106 further supports the timing pinions 30, 32, 34 and 36 within the housing 104.

The valve controller 14 further includes the intake cam follower assemblies 22*a*, 22*b*, 22*c* and 22*d* (22*b* not shown) and the exhaust cam follower assemblies 20*a*, 20*b*, 20*c* and 20*d* (20*b* not shown) positioned in the housing 104. The intake cam follower assemblies 22*a*–22*d* and the exhaust cam follower assemblies 20*a*–20*d* are spaced radially about the cam shaft 100.

In the embodiment shown in FIG. 3, there are four intake cam follower assemblies and four exhaust cam follower assemblies since the valve controller 14 is designed for use with a four cylinder engine. Preferably, the number of intake cam follower assemblies and the number of exhaust cam follower assemblies is equal to the number of cylinders in the engine. In an alternative embodiment, an eight cylinder engine, for example, would have eight intake and eight exhaust cam followers spaced radially about the cam shaft.

The intake cam follower assembly 22*d* includes an aperture 130*d* for accepting the intake hydraulic line 24*d* (not shown). The intake cam follower assembly 22*d* further includes a locking tube end screw 132*d* that secures the hydraulic line to the cam follower assembly. A cam follower sleeve 134*d* surrounds the intake cam follower assembly 22*d* and is secured to the housing 104 by a plurality of screws 136*d*.

Similarly, the exhaust cam follower assembly 20*d* includes an aperture 140*d*, a locking tube end screw 142*d*, a cam follower sleeve 144*d*, and a plurality of screws 146*d*. The intake cam follower assemblies 22*a*–22*c* and the exhaust cam follower assemblies 20*a*–20*c* have identical components to those mentioned with respect to the intake cam follower assembly 22*d* and the exhaust cam follower assembly 20*d*.

A plurality of holes 115 and 121 are drilled into the housing 104. The holes 115 pass through the housing 104 and connect to the intake cam follower assemblies 22*a*–22*d*. The holes 121 pass through the housing 104 and connect to the exhaust cam follower assemblies 20*a*–20*d*. The replenishing lines 45 (shown in FIG. 1*a*) connect to the holes 115 and 121. The holes 115 and 121 form channels that direct hydraulic fluid from the engine lubricating pump 43 to each cam follower assembly to replace the fluid lost in the controller 14 and in each valve assembly. For example, the replenishing lines 45 may be connected to the hole 121 to direct fluid through the hole, through the check valves 47*a*–47*d* (shown in FIG. 1*a*), and in to the exhaust cam follower assemblies 20*a*–20*d*. A plurality of pipe plugs 114 and 120 plug the ends of the holes 115 and 121 to seal the formed channels.

5. Exhaust End

Figure 4:
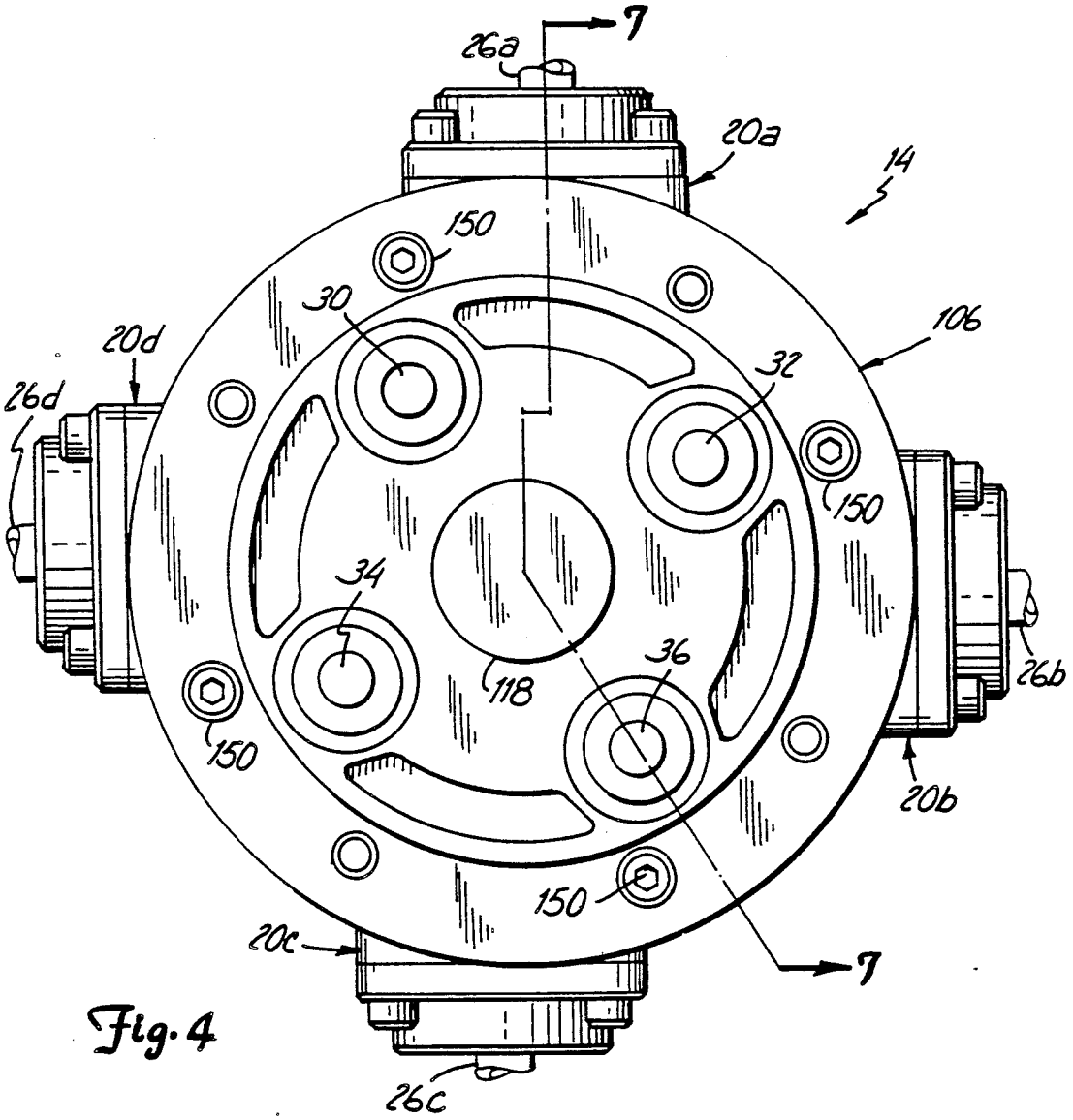
FIG. 4 is a view in end elevation of an exhaust end of the valve controller as seen from line 4—4 of FIG. 3.
Figure 7:
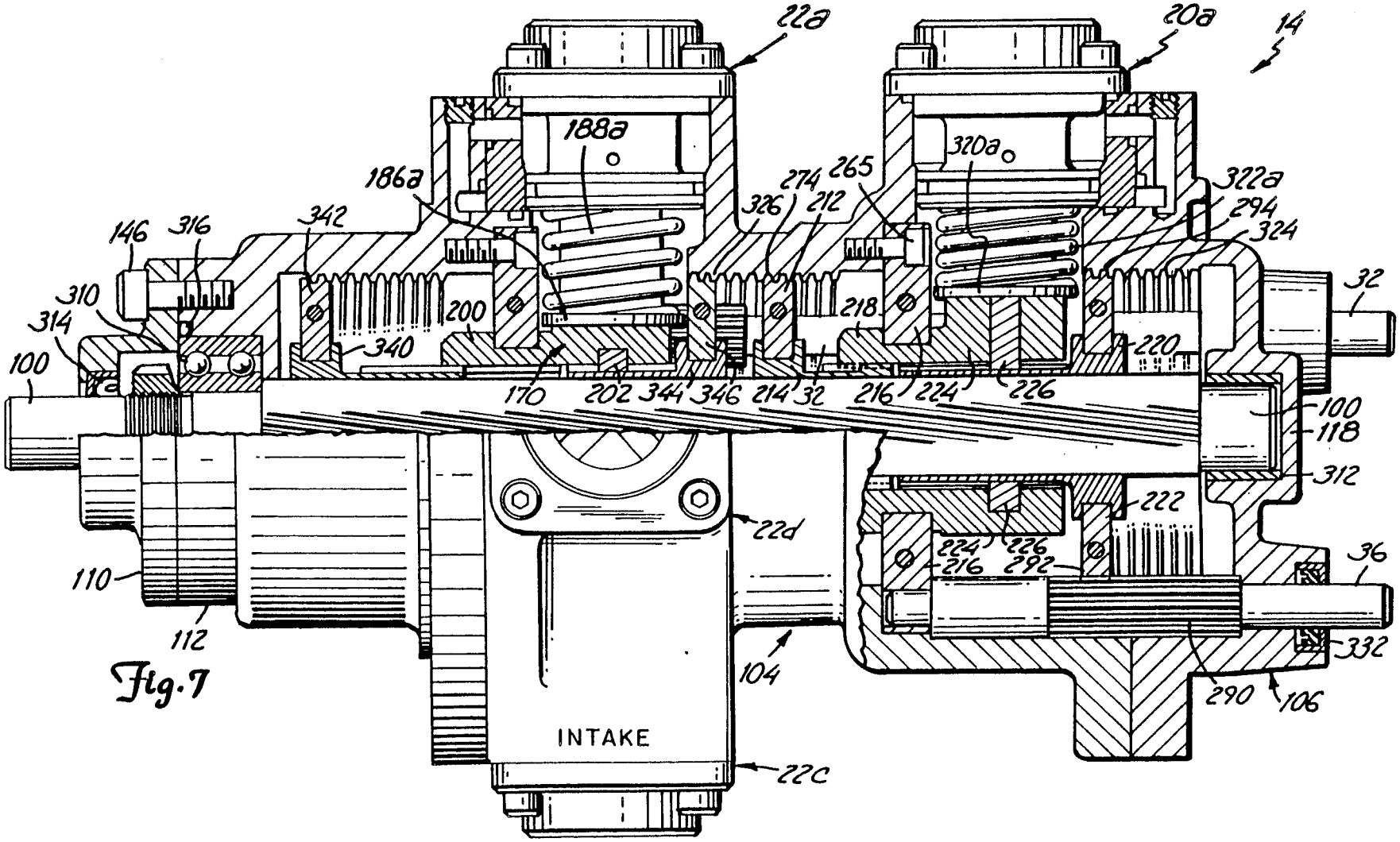
FIG. 7 is a view in side elevation of the valve controller of FIGS. 3-6 with portions broken away for illustration of intake and exhaust timing adjustment assemblies.

FIG. 4 is a view in end elevation of an exhaust end of the valve controller 14 as seen from line 4—4 of FIG. 3. A plurality of screws 150 secure the shaft end cap 106 to the housing 104 (shown in FIG. 3). The shaft end cap 106 supports the timing pinions 30, 32, 34 and 36 within the housing 104. The shaft end cap 106 includes the hub 118 which supports the distal end of the cam shaft 100 (as shown in FIG. 7).

The exhaust cam follower assemblies 20*a*–20*d*, are spaced radially about the cam shaft 100. The exhaust hydraulic lines 26*a*–26*d* are secured to the exhaust cam follower assemblies 20*a*–20*d*, respectively. The hydraulic lines 26*a*–26*d* transmit hydraulic signals from the valve controller 14 to the individual exhaust valve assemblies 18*a*–18*d* on the engine head 12. For example, the exhaust hydraulic line 26*a* transmits hydraulic signals from the exhaust cam follower assembly 20*a* to the exhaust valve assembly 18*a* (shown in FIG. 2) for actuating the valve 50 between opened and closed positions within the cylinder 44.

6. Intake End

Figure 5:
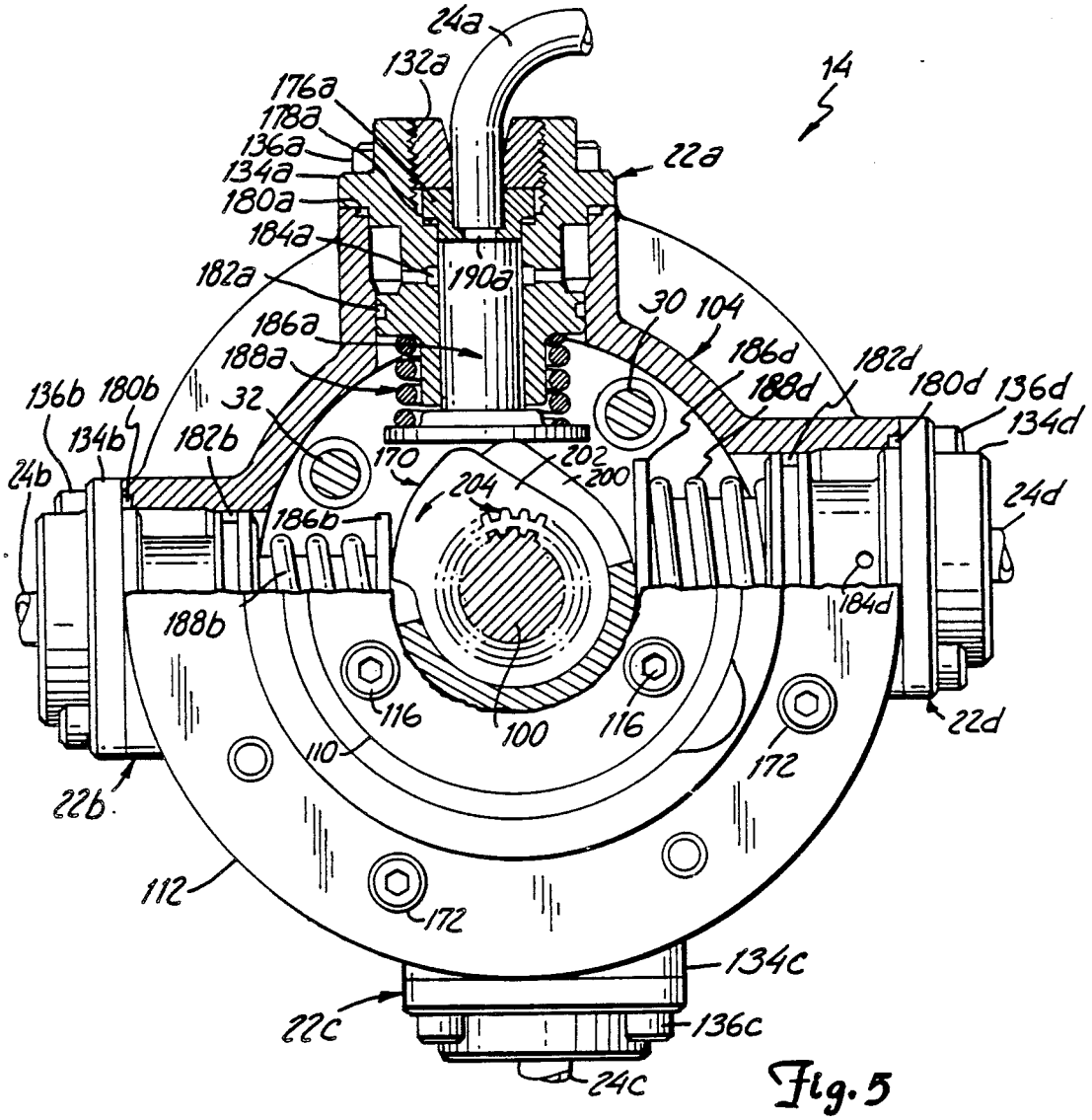
FIG. 5 is a view in end elevation of an intake end of the valve controller as seen from line 5—5 of FIG. 3.

FIG. 5 is a view in end elevation of an intake end of the valve controller 14 as seen from line 5—5 of FIG. 3. Portions have been broken away for illustration. The valve controller 14 includes the intake cam follower assemblies 22*a*–22*d*, the bearing cap 110, the bearing housing 112, the housing 104, the timing pinions 30 and 32, the cam shaft 100, and an intake cam assembly 170. The screws 116 secure the bearing cap 110 to the bearing housing 112. A plurality of screws 172 secure the bearing housing 112 to the housing 104.

The intake cam follower assemblies 22*a*, 22*b*, 22*c* and 22*d* are substantially the same and perform similar functions. Further, the exhaust cam follower assemblies 20*a*–20*d* (not shown) are similar to the intake cam follower assemblies 22*a*–22*d*. For simplicity, a detailed discussion is limited to the intake cam follower assembly 22*a*.

The intake cam follower assembly 22*a* includes the locking tube end screw 132*a*, a tube end fitting 176*a*, a fitting gasket 178*a*, the cam follower sleeve 134*a*, the screws 136*a*, O-rings 180*a* and 182*a*, a fluid replacement port 184*a*, a cam follower 186*a*, and a cam follower return spring 188*a*.

The tube end fitting 176*a* holds the end of the intake hydraulic line 24*a* within the intake cam follower assembly 22*a*. The tube end fitting 176*a* is preferably silver soldered to the intake hydraulic line 24*a*. The locking tube end screw 132*a* secures the tube end fitting 176*a* and the hydraulic line 24*a* to the intake cam follower assembly 22*a*. The fitting gasket 178*a* creates a fluid-tight seal between the tube end fitting 176*a* and the cam follower sleeve 134*a*. The O-rings 180*a* and 182*a* provide fluid-tight seals between the cam follower sleeve 134*a* and the housing 104, respectively.

7. Cam Follower Operation

The intake cam follower 186*a* follows the circumference of the intake cam assembly 170 as it rotates with the cam shaft 100 within the housing 104. The cam follower return spring 188*a* urges the intake cam follower 186*a* against the surface of the intake cam assembly 170 by applying a "spring" force on the follower which is normal to the cam surface. The intake cam assembly 170 actuates the intake cam follower 186*a* between a normally extended position and a depressed position. In other words, the intake cam follower 186*a* moves up and down as the intake cam assembly 170 rotates. Similarly, the intake cam followers 186*b*, 186*c* (not shown), and 186*d* follow the circumference of the intake cam assembly 170 as it rotates. FIG. 5 illustrates the intake cam follower 186*a* in the depressed position and the intake cam followers 186*b*, 186*c* and 186*d* in the normally extended position.

When actuated into the depressed position, the intake cam follower 186*a* applies pressure to the hydraulic fluid within a chamber 190*a*. The hydraulic fluid creates a positive pressure head that travels along the intake hydraulic line 24*a* to the valve piston 70 of the intake valve assembly 16*a*. The positive pressure head actuates the intake valve 59 into the opened position (see FIG. 2). As the intake cam assembly 170 continues to rotate, the intake cam follower 186*a* returns to the normally extended position and releases the positive pressure head from the valve piston 70. Thereafter, the intake valve spring 61 returns the intake valve 59 to the closed position and the hydraulic fluid refills the chamber 190*a*.

The hydraulic fluid may be replaced through the fluid replacement ports 184*a*–184*d* (184*b* and 184*c* not shown). In an alternative embodiment, commercially available check valves, such as the check valves 47*a*–47*d* shown in FIG. 1*a*, may be used instead of the replacement ports 184*a*–184*d*. Each check valve replaces lost hydraulic fluid when the fluid pressure drops below a given value. For example, when the fluid pressure drops below the given value within the chamber 190a, the check valve allows replacement fluid, which is pressurized higher than the given value, to enter the chamber 190a and replace the lost fluid. The engine lubricating pump 43 (shown in FIG. 1a) supplies the replacement fluid through the replenishing lines 45. In the preferred embodiment, the hydraulic fluid comprises engine oil used to lubricate the engine 10. In this manner, the hydraulic fluid is recycled and filtered through an engine oil filter (not shown).

The intake cam assembly 170 is a two-piece cam that includes an opening cam 200 and a closing cam 202. The opening cam 200 and the closing cam 202 are generally ring-shaped for positioning on the cam shaft 100. The opening cam 200 forces the intake cam follower 186a into the depressed position and thereby forces the intake valve 59 into the opened position. The angular position of the opening cam 200 with respect to the cam shaft 100 determines when the intake valve 59 opens with respect to the piston position. The more the opening cam 200 is advanced, the earlier the intake valve 59 will open in the combustion cycle. The more the opening cam 200 is retarded, the later the intake valve 59 will open in the combustion cycle. The angular positioning of the closing cam 202 with respect to the opening cam 200 determines how long the intake valve 59 remains in the opened position.

The cam shaft 100, the opening cam 200, and the closing cam 202 include splines 204 which force the two cams to rotate with the cam shaft, in a direction indicated by an arrow 207, while allowing for adjustment of the angular positions. The angular position of the opening cam 200 may be adjusted by rotating the intake cam opening timing pinion 30. The angular position of the closing cam 202 may be adjusted by rotating the intake cam close timing pinion 32. These adjustments are shown in greater detail in FIGS. 6 and 7.

8. Exhaust Timing Adjustment

Figure 6:
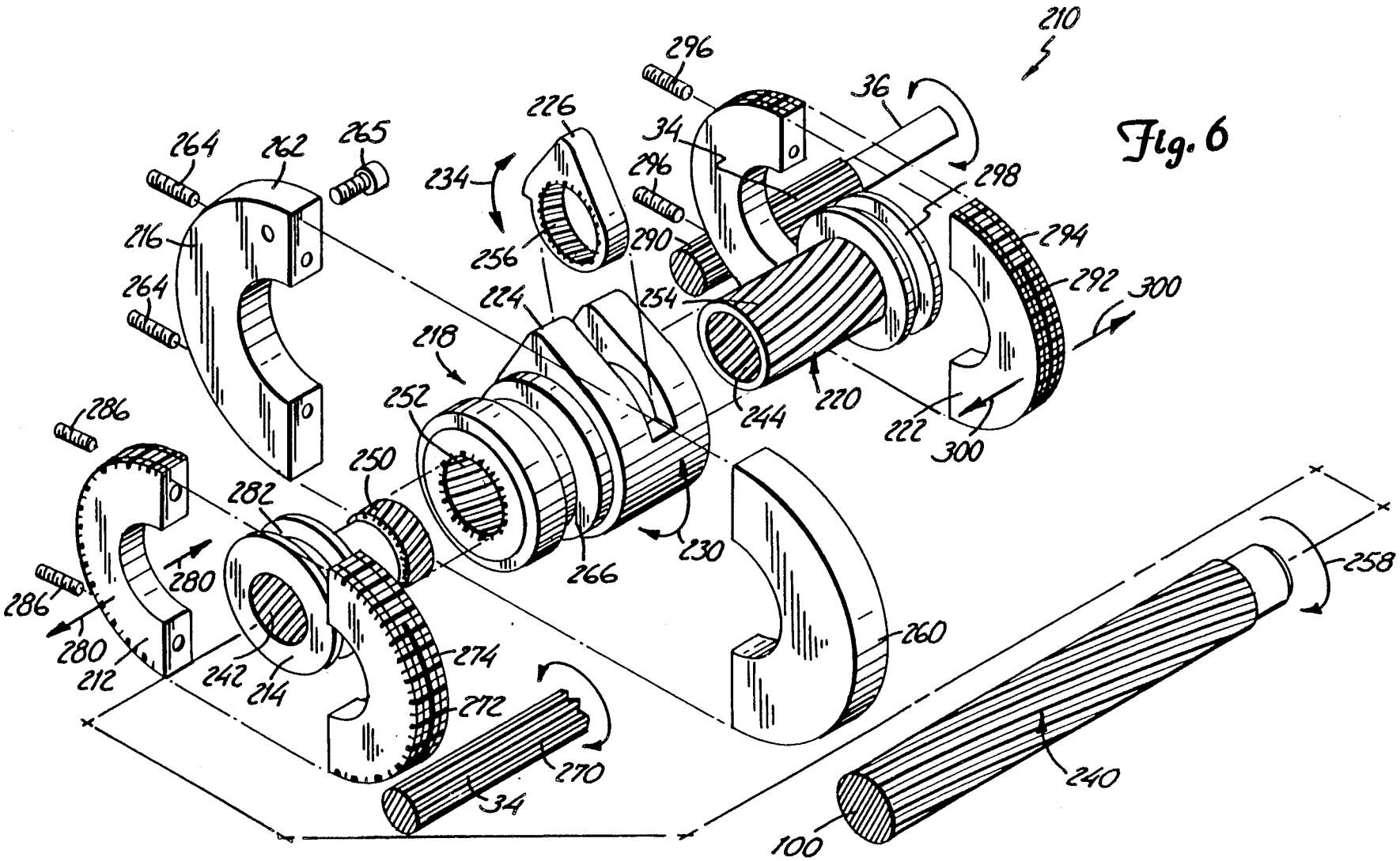
FIG. 6 is an exploded view of an exhaust valve timing adjustment assembly positioned within the valve controller of FIGS. 3-5.

FIG. 6 is an exploded view of an exhaust valve timing adjustment assembly 210 positioned within the valve controller 14. The timing adjustment assembly 210 includes the cam shaft 100, the exhaust cam open timing pinion 34, an exhaust cam open timing gear 212, an exhaust cam open timing sleeve 214, an exhaust cam open thrust plate 216, an exhaust cam assembly 218, an exhaust cam close timing sleeve 220, an exhaust cam close timing gear 222, and the exhaust cam close timing pinion 36.

The exhaust cam assembly 218 is substantially the same as the intake cam assembly 170 shown in FIG. 5 and includes an opening cam 224 and a closing cam 226. The opening cam has a much larger surface area than does the closing cam 226. During rotation, the opening cam 224 must exert enough force to accelerate the exhaust cam followers into the depressed positions. The closing cam 226 merely lowers the cam followers into the extended positions. Therefore, the opening cam 224 requires greater surface area to withstand the acceleration forces.

Advancing or retarding the opening cam 224 and the closing cam 226 varies the timing of the exhaust valve 50 (shown in FIG. 2). In other words, the timing is adjusted by changing the angular position of the opening cam 224 and the closing cam 226 with respect to the cam shaft 100. The adjustments for the opening cam 224 are indicated by arrows 230. These adjustments are controlled by the exhaust cam open timing pinion 34, the exhaust cam open timing gear 212, and the exhaust cam open timing sleeve 214. Arrows 234 indicate the angular adjustments for the closing cam 226. These adjustments are controlled by the exhaust cam close timing pinion 36, the exhaust cam close timing gear 222, and the exhaust cam close timing sleeve 220.

The cam shaft 100 has an outside diameter surface with a helical spline 240 that extends substantially the entire length of the cam shaft. The helical spline 240 is cut in a first direction with respect to the circumference of the cam shaft 100. The exhaust cam open timing sleeve 214 has an inside diameter surface with a helical spline 242 that meshes with the spline 240. Similarly, the exhaust cam close timing sleeve 220 has an inside diameter surface with a helical spline 244 that meshes with the spline 240.

The exhaust cam open timing sleeve 214 has an outside diameter surface with a helical spline 250 which is cut in a second direction, opposite the first direction. The opening cam 224 has an inside diameter surface with a helical spline 252 that meshes with the spline 250. Similarly, the exhaust cam close timing sleeve 220 has an outside diameter surface with a helical spline 254 which is cut in the second direction. The closing cam 226 has an inside diameter surface with a helical spline 256 that meshes with the spline 254.

During operation, the cam shaft 100 rotates with the crankshaft (not shown) of the engine 10 in a direction indicated by an arrow 258. The meshing splines cause the timing sleeves 214 and 220 and the cams 224 and 226 to rotate with the cam shaft 100.

The exhaust cam thrust plate 216 includes first and second halves 260 and 262. Dowel pins 264 secure the first half 260 to the second half 262 such that the thrust plate 216 fits within a groove 266 on the exhaust cam assembly 218. A screw 265 secures the thrust plate 216 to the housing 104 (not shown). The thrust plate 216 is stationary and provides bearing surfaces that stabilize rotation of the exhaust cam assembly 218 in the radial and lateral directions. In particular, the thrust plate 216 prevents the exhaust cam assembly 218 from traveling laterally along the cam shaft 100.

Rotating the exhaust cam open timing pinion 34 adjusts the angular position of the opening cam 224. The timing pinion 34 has an outside diameter surface with gear teeth 270 along its length. The gear teeth 270 mesh with gear teeth 272 on the outside diameter surface of the exhaust cam open timing gear 212.

Rotation of the timing pinion 34 causes the timing gear 212 to rotate. The outside diameter of the timing gear 212 further includes a thread 274 around its circumference. The thread 274 meshes with a thread on the housing 104 (not shown). Rotating the timing gear 212 causes the timing gear to move laterally (indicated by arrows 280) along the length of the cam shaft 100 with the threads 274.

The exhaust cam open timing sleeve 214 includes a groove 282. Dowel pins 286 secure first and second halves of the timing gear 212 together such that the timing gear fits into the groove 282. The timing gear 212 provides a thrust bearing surface that stabilizes lateral movement of the timing sleeve 214. The timing gear 212 is normally stationary and only rotates during adjustment.

When the timing gear 212 rotates and moves laterally along the cam shaft 100, the timing gear forces the timing sleeve 214 to also move laterally along the cam shaft 100. The lateral movement of the timing sleeve 214 forces the timing sleeve to rotate with the helical splines 240 and 242. Since the thrust plate 216 prevents the opening cam 224 from also moving laterally, the lateral and rotational movement of the timing sleeve 214 forces the opening cam to rotate along the helical splines 250 and 252. The angular position of the opening cam 224 is therefore adjusted by rotating the exhaust open timing pinion 34.

Similarly, the angular position of the closing cam 226 is adjusted by rotating the exhaust cam close timing pinion 36. The timing pinion 36 includes gear teeth 290 that mesh with gear teeth 292 on the exhaust cam close timing gear 222. The timing gear 222 includes a thread 294 that meshes with a thread on the housing 104 (not shown). Dowel pins 296 secure first and second halves of the timing gear 222 together such that the timing gear fits in a groove 298 on the exhaust cam close timing sleeve 220. Rotation of the timing pinion 36 causes the timing gear 222 and the timing sleeve 220 to move laterally about the length of the cam shaft 100 (indicated by arrows 300). The lateral movement of the timing sleeve 220 forces the timing sleeve to rotate along the helical splines 240 and 244. Since the opening cam 224 prevents the closing cam 226 from moving laterally, the lateral and rotational movement of the timing sleeve 220 forces the closing cam 226 to rotate along the helical splines 254 and 256. Rotating the exhaust cam close timing pinion 36 therefore adjusts the angular position of the closing cam 226.

The present invention does not require that both pairs of mating splines be helical, but that at least one pair of mating splines be helical to affect angular positioning of a particular cam. For example, to affect the angular positioning of the opening cam 224, the splines 240 and 242 may be straight provided the splines 250 and 252 are helical. Alternatively, the splines 250 and 252 may be straight provided the splines 240 and 242 are helical. In the preferred embodiment, however, both pairs of mating splines are helical because the timing sleeve 214 requires less lateral movement to cause a given change in the angular position of the opening cam 224 than it would if one pair of the mating splines were straight.

The valve controller 14 further includes an intake valve timing adjustment assembly which is similar to the exhaust valve timing adjustment assembly 210 described with reference to FIG. 6.

FIG. 7 is a view in side elevation of the valve controller 14 with portions broken away for illustration. The housing 104 substantially encloses the cam shaft 100. A bearing 310 supports the proximal end of the cam shaft 100. The bearing housing 112 supports the bearing 310 about the cam shaft 100. In the preferred embodiment, the bearing 310 is a double row ball bearing that carries both radial and lateral (thrust) loads. A seal 314 creates a fluid-tight seal between the rotating cam shaft 100 and the bearing cap 110. An O-ring 316 provides a fluid-tight seal between the first portion 110 and the second portion 112. A bushing 312 supports the distal end of the cam shaft 100. The bushing 312 is positioned within the hub 118 of the shaft end cap 106.

Since the cam shaft 100 is driven at the proximal end, the resulting forces on the bearing 310 are much greater than the forces on the bushing 312. Therefore, a high quality bearing is used at the proximal end and a less expensive bushing is used at the distal end. However, other types of bearings may be used as substitutes for the bearing 310 and the bushing 312.

The visible cam follower assemblies in FIG. 7 include the intake cam follower assemblies 22*a*, 22*c*, and 22*d* and the exhaust cam follower assembly 20*a*. The exhaust cam follower assembly 20*a* includes an exhaust cam follower 320*a* and an exhaust cam follower return spring 322*a*. Cam follower 320*a* is forced into the depressed position by the exhaust cam assembly 218. The exhaust cam includes the opening cam 224 and the closing cam 226. The screw 265 secures the thrust plate 216 to the housing 104.

Rotating the exhaust cam close timing pinion 36 changes the angular position of the closing cam 226. The gear teeth 290 mesh with the gear teeth 292 in the exhaust cam close timing gear 222. The threads 294 mesh with threads 324 in the housing 104. As the timing gear 222 rotates, the threads 294 and 324 move the timing gear and the timing sleeve 220 laterally along the length of the cam shaft 100. A seal 332 provides a fluid-tight seal between the shaft end cap 106 and the timing pinion 36. Similar seals are positioned about the timing pinions 30, 32 and 34.

In a similar manner, rotation of the exhaust cam open timing pinion 34 (shown in FIGS. 1, 3. 4 and 6) causes the exhaust cam open timing gear 212 to rotate and move laterally along the threads 274 and 326. The lateral movement of the exhaust cam open timing gear 212 changes the angular position of the opening cam 224.

The angular position of the intake cams may also be adjusted. The intake valve timing adjustment assembly includes the opening cam 200, an intake cam open timing sleeve 340, an intake cam open timing gear 342, and the intake cam open timing pinion 30 (shown in FIG. 4). The assembly further includes the closing cam 202, an intake cam close timing sleeve 344, an intake cam close timing gear 346, and the intake cam close timing pinion 32. Operation of the intake valve timing adjustment assembly is identical to the operation of the exhaust valve timing adjustment assembly described with reference to FIG. 6.

9. Alternative Timing Assembly

Figure 8:
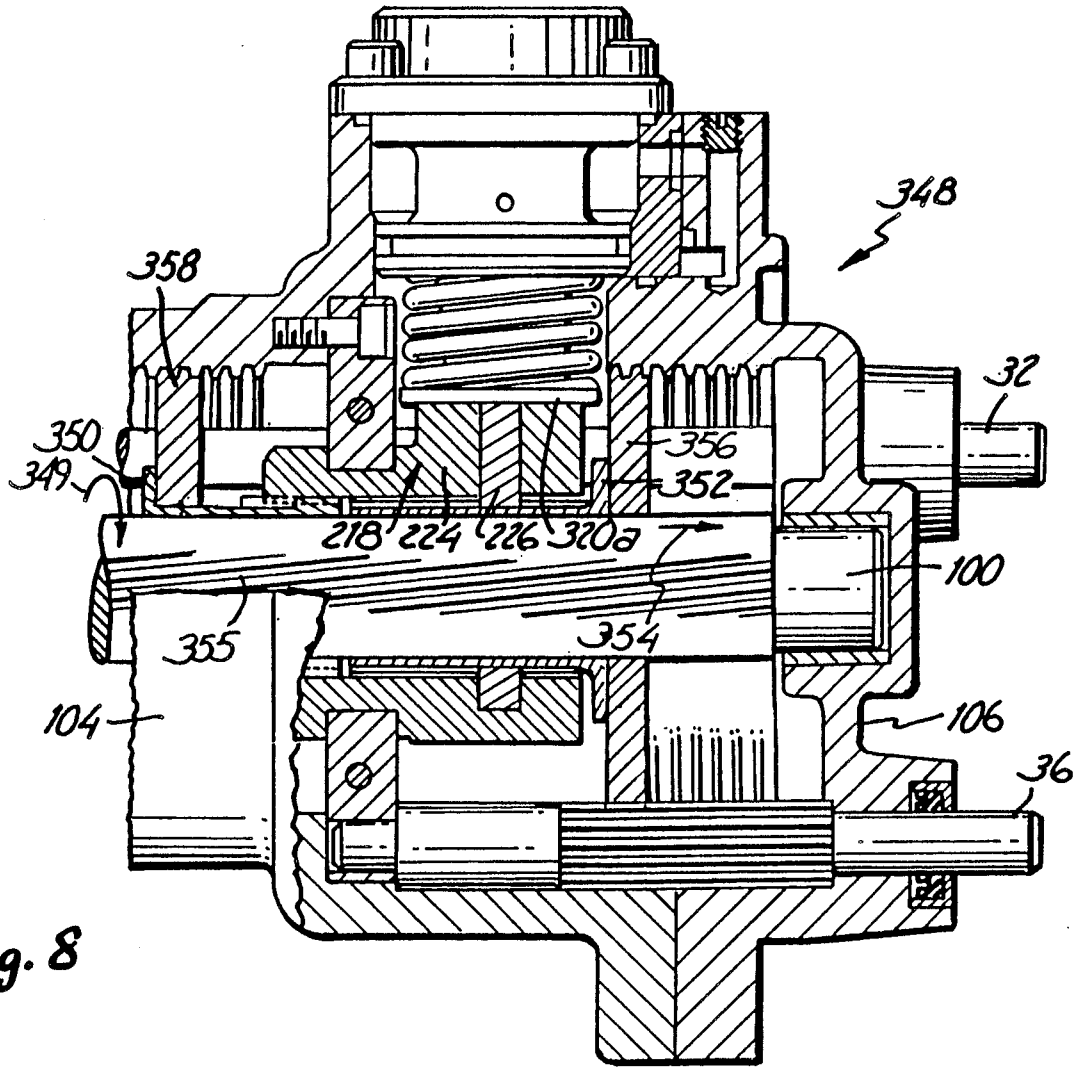
FIG. 8 is a fragmentary detail of a portion of the exhaust end of the valve controller of FIGS. 3-7 that illustrates an alternative exhaust timing adjustment assembly.

FIG. 8 is a fragmentary detail of a portion of FIG. 7 that illustrates an alternative exhaust timing adjustment assembly 348. The cam shaft 100 rotates in a direction indicated by an arrow 349. The opening cam 224, the closing cam 226, and the timing sleeves 350 and 352 each have non-locking helical splines that force them to rotate with the cam shaft. As the cam follower 320*a* follows the circumference of the opening and closing cams 224 and 226, friction between the cam follower and the opening and closing cams "tries" to inhibit rotation. The friction forces the timing sleeves 350 and 352 to rotate and to travel in a lateral direction (indicated by arrow 354) along a non-locking helical spline 355. A timing gear 356 prevents the timing sleeve 352 from traveling in the direction indicated by the arrow 354. Similarly, a timing gear 358 prevents the timing sleeve 350 from traveling in the direction indicated by the arrow 354.

Rotation of the timing sleeves 350 and 352 forces the exhaust cam assembly 218 in a lateral direction opposite to the arrow 354. A thrust plate 364 prevents the exhaust cam assembly 218 from traveling in the lateral direction. The thrust plate 364 may be made of a unitary piece, unlike the thrust plate 216 (shown in FIG. 6) which must fit within the groove 266 in the opening cam 224.

A timing adjustment may be made by moving the timing gear 356 in a direction opposite to the arrow 354. This movement forces the timing sleeve 352 to rotate along the splines 355 to thereby change the angular position of the closing cam 226. Alternatively, the timing gear may be moved in a direction with the arrow 354. This movement allows the timing sleeve 352 to travel along the splines 240 in the direction indicated by the arrow 354 to thereby change the angular positioning of the closing cam 226. Similar timing adjustments may be made with the timing gear 358 to affect angular positioning of the opening cam 224. It should be understood that the alternative exhaust timing adjustment assembly 348 shown in FIG. 8 may be used with the intake timing adjustment assembly.

A number of factors determine the magnitude of the lateral force created during rotation. One factor is the magnitude of the friction between the cams and the cam followers. Another factor is the angle of the helical splines, as measured with the longitudinal axis of the cam shaft 100. The lateral force may be selected by cutting the helical splines at a chosen angle.

One advantage of the embodiment shown in FIG. 8 is that the timing gears 356 and 358 may be manufactured as a unitary piece. The timing gears 356 and 358 do not have to fit into grooves within the timing sleeves 350 and 352, unlike the timing gear 212 which must fit into the groove 282 of the sleeve 214 (shown in FIG. 6). However, the embodiment shown in FIG. 6 does not require special design of the spline angles. The timing gears 212 and 222 can force the timing sleeves 214 and 220 in either lateral direction. The particular application and design requirements will determine which embodiment is used.

CONCLUSION

The valve control system of the present invention provides greater flexibility in timing parameter adjustments than does the prior art. Valve overlap may be adjusted by changing the relative angular positions of the intake cams and the exhaust cams. The intake cams and the exhaust cams are independently adjustable. The adjustments are made by advancing or retarding the opening cams and the closing cams on either or both of the intake cam and the exhaust cam. Further, the adjustments can be made relative to one another or relative to the crank shaft positioning. Adjustments made to either the intake cam or to the exhaust cam are made independently of the adjustments to the other cam.

The engine performance is no longer limited by the design of the cam shaft. Improvements to the engine performance include fuel efficiency, power output, and emissions. For diesel engines, the improvements further include improved starting and a reduction of diesel "knock", among others. For improved starting, the timing may be adjusted to close the intake valve at the bottom of the piston stroke to obtain full compression of the fuel/air mixture. The increased compression brings the temperature of the compressed fuel/air mixture sufficiently above the ignition temperature to improve starting performance.

The present invention also compensates for inherent properties of hydraulic systems. Compression of the hydraulic fluid and elasticity of the hydraulic lines retard valve acceleration during the opening cycle. This retardation is greater at higher engine speeds than at lower engine speeds. The present invention compensates for this effect by advancing the opening cams farther at higher engine speeds. Since the present invention is fully adjustable, the cams may be advanced far enough to compensate for hydraulic time delays. Therefore, even at high engine speeds, the hydraulic signals are still effective for controlling valve actuation.

In addition to optimizing timing parameters, engine power is improved by increasing the valve area to move the fuel/air mixture into and the exhaust out of each cylinder more efficiently. The valve area is increased by either increasing the diameter of each valve head or by increasing the number of valves per cylinder. In both cases, valve area in the present invention is increased more easily than in conventional engines with mechanically operated valves.

The diameter of the cylinder and the optimum shape of the combustion chamber limit the diameter of each valve. The combustion chamber is the general surface of the cylinder head that contains the valve ports, such as valve port 52 (shown in FIG. 2). The combustion chamber preferably has a hemispherical shape that optimizes the surface area for fuel/air mixture ignition. Increasing the valve diameter requires a valve orientation that is not possible with conventional valve controller designs. Increasing the number of valves per cylinder in conventional engines also adversely affects the shape of the combustion chamber and increases complexity of the cam shaft. For example, a four cylinder engine having two intake valves and two exhaust valves per cylinder requires a cam shaft system with sixteen cam lobes, one for each valve in the engine. Further, orientation of the valves is limited by the cam shaft design.

In the present invention, the orientation of the valve assemblies, such as exhaust valve assembly **18*a*, is not limited by the design and positioning of a cam shaft. The exhaust hydraulic line 26*a* may be formed to operate effectively at virtually any orientation. The shape of the combustion chamber of the cylinder 44** can therefore be optimized by valve orientation.

The present invention is also easily adaptable to additional valve assemblies because a single cam follower can drive more than one valve. For example, the present invention can support two intake and two exhaust valve assemblies per cylinder. In FIG. 2, the hydraulic line **26*a* is merely split to control two exhaust valve assemblies 18*a* with the same hydraulic signals. Similarly, the intake hydraulic line 24*a* is split to control two intake valve assemblies 16*a*** with the same hydraulic signals. Orientation of the four valve assemblies is easily modified to optimize the shape of the combustion chamber and is not limited to a cam shaft design or positioning. It should be understood that the present invention supports any number of parallel valve assemblies in a given cylinder with only one cam follower per set of paralleled valves. Preferably, all of the valve springs have the same spring rate so that a set of paralleled intake or exhaust valves will move together within the cylinder.

The present invention also allows for optimum placement of a sparkplug in the cylinder 44. Two factors are considered when positioning a sparkplug; maximum firing efficiency and accessibility for maintenance. For maximum firing efficiency, the sparkplug (not shown) is positioned at the center of the combustion chamber between the valve assemblies **16*a* and 18*a*. When the sparkplug is in this position, the fuel/air mixture burns evenly within the cylinder 44** to provide an even, stable force on a piston (not shown). The result is a more efficient burning of the fuel/air mixture and an increase in engine power and efficiency.

Sparkplug positioning on conventional engines with mechanically operated valves is limited by the position of the cam shaft. There is less available space to position the sparkplug. Often, sparkplug positioning or valve orientation and area is sacrificed.

In an alternative embodiment, the hydraulic valve controller of the present invention may be used with an engine that is run at a constant speed and at a constant torque. At constant speed and constant torque, the valve timing can remain fixed. In this embodiment, all elements required to change valve timing may be eliminated to simplify the valve controller design.

Although the present invention has been described with reference to preferred embodiments, workers skilled in the art will recognize that changes may be made in form and detail without departing from the spirit and scope of the invention. For example, the present invention does not require both a cam follower return spring and a valve return spring. The cam follower spring may be eliminated if the valve spring is strong enough to create sufficient fluid pressure in the hydraulic line to force the cam follower against the cam so that the follower follows the cam's surface.

What is claimed is:

1. An adjustable cam shaft assembly for controlling at least one engine valve between an opened position and a closed position as a function of piston position, the cam shaft assembly comprising:

a cam housing;

a cam shaft having a circumference for rotation within the cam housing as a function of engine speed, the cam shaft having an exterior diameter surface with a spline along the length of the shaft;

a cam coupled to the cam shaft for rotation with the cam shaft such that the cam has an adjustable angular position with respect to the cam shaft circumference, wherein the cam includes a ring-shaped body with an aperture for accepting the cam shaft, the ring-shaped body including an interior diameter surface having a spline;

a timing sleeve positioned between the cam and the cam shaft, the sleeve including an exterior diameter surface having a spline for mating with the spline on the exterior diameter surface of the cam shaft; the sleeve further including an interior diameter surface having a spline for mating with the spline on the exterior diameter surface of the cam shaft;

wherein at least one pair of mating splines are helical; and wherein lateral movement of the timing sleeve with respect to the length of the cam shaft and the cam varies the angular position of the cam with respect to the cam shaft circumference.

2. The adjustable cam shaft assembly of claim 1 wherein:

the spline on the interior diameter surface of cam body is helical;

the spline on the exterior diameter surface of the timing sleeve is helical;

the spline on the interior diameter surface of the timing sleeve is straight; and the spline on the exterior diameter surface of the cam shaft is straight.

3. The adjustable cam shaft assembly of claim 1 wherein:

the spline on the interior diameter surface of the cam body is straight;

the spline on the exterior diameter surface of the timing sleeve is straight;

the spline on the interior diameter surface of the timing sleeve is helical; and the spline on the exterior diameter surface of the cam shaft is helical.

4. The adjustable cam shaft assembly of claim 1 wherein:

the spline on the interior diameter surface of the cam body is helical and cut in a first direction;

the spline on the exterior diameter surface of the timing sleeve is helical and cut in the first direction;

the spline on the interior diameter surface of the timing sleeve is helical and cut in a second direction, opposite the first direction; and the spline on the exterior diameter surface of the cam shaft is helical and cut in the second direction.

5. The adjustable cam shaft assembly of claim 1 and further comprising:

an annular timing gear positioned about the cam shaft and adjacent the timing sleeve for affecting lateral movement of the timing sleeve, the timing gear including an exterior diameter surface having a screw thread and gear teeth about its circumference;

a timing pinion having gear teeth along its outer surface which mesh with the gear teeth on the timing gear such that rotation of the timing pinion causes an opposite rotation of the timing gear; and wherein the cam housing includes a screw thread that meshes with the timing gear screw thread, the screw threads causing the timing gear to move laterally with respect to the cam shaft in a direction dependent upon the direction of rotation of the timing pinion.

6. The adjustable cam shaft assembly of claim 5 wherein the timing sleeve further includes an annular groove in which the annular timing gear is seated for applying lateral force on the timing sleeve to thereby affect lateral movement of the timing sleeve, the annular timing gear being formed out of at least two portions to facilitate attachment within the annular groove.

7. The adjustable cam shaft assembly of claim 5 wherein the annular timing gear is a unitary piece positioned adjacent the timing sleeve for affecting lateral movement of the timing sleeve by urging the timing sleeve in a first direction and by inhibiting timing sleeve travel in a second, opposite direction.

* * * * *

UNITED STATES PATENT AND TRADEMARK OFFICE

CERTIFICATE OF CORRECTION

PATENT NO. : 5,125,372

DATED : June 30, 1992

INVENTOR(S) : JOHN T. GONDEK

It is certified that error appears in the above-identified patent and that said Letters Patent is hereby corrected as shown below:

Col. 15, line 46, delete "exterior", insert "interior"

Col. 15, line 46, delete "cam shaft", insert "cam body"

Signed and Sealed this

Tenth Day of August, 1993

*Attest:*

Michael K. Kirk

MICHAEL K. KIRK

*Attesting Officer*

*Acting Commissioner of Patents and Trademarks*